US006288498B1

(12) United States Patent
Cheng

(10) Patent No.: US 6,288,498 B1
(45) Date of Patent: Sep. 11, 2001

(54) STRUCTURE OF FLICKERING DECORATION LIGHT

(76) Inventor: Chen-An Cheng, No. 33, Lane 340, Section 1, Hai Tian Road, Tainan (TW)

( * ) Notice: Subject to any disclaimer, the term of this patent is extended or adjusted under 35 U.S.C. 154(b) by 0 days.

(21) Appl. No.: 09/696,034

(22) Filed: Oct. 26, 2000

(51) Int. Cl.[7] ..... H05B 37/00

(52) U.S. Cl. ..... 315/185 S; 315/200 A; 362/806; 362/362; 362/195; 362/800

(58) Field of Search ..... 315/185 S, 200 A, 315/363; 313/806, 362, 195, 223, 800

(56) References Cited

U.S. PATENT DOCUMENTS 5,097,180 * 3/1992 Ignon et al. ..... 315/200 A 5,567,036 * 10/1996 Theobald et al. ..... 362/80

* cited by examiner

*Primary Examiner*—Don Wong
*Assistant Examiner*—Tuyet T. Vo
(74) *Attorney, Agent, or Firm*—Rosenberg, Klein & Lee

(57) ABSTRACT

A structure of flickering decoration light is assembled by a light base and a pressing cover. The flickering circuit is switched by the electricity-conducting portion of an electric circuit plate provided in the interior of the pressing cover. The upper inner wall of the light base is provided with a catching flange, and the bottom circumference of the pressing cover is provided with a stopping flange so as to be movably caught in the catching flange the light base by force. An elastic against post is provided with a conductor in the top and is glued to connect with the electricity-conducting portion of the electric circuit plate so as to stop against between the electric circuit plate and the light base. A fastening article is provided on the outer bottom surface of the light base. The pressing cover can be pressed to switch the electric circuit to make the decoration light flicker or be extinguished.

1 Claim, 3 Drawing Sheets

STRUCTURE OF FLICKERING DECORATION LIGHT

BACKGROUND OF THE INVENTION

1. Field of the Invention

The present invention relates to a structure of flickering decoration light, whose pressing cover can be pressed to touch the elastic against post to make the electric circuit plate generate electric energy and make the light flicker.

2. Description of the Related Art

Referring to FIGS. 1 and 2, a conventional structure of flickering decoration light includes a light base 11 and a cover 19. The light base 11 is provided with a switching button 12 in the bottom, and an electric circuit plate 13 is provided in the groove 111 of the light base 11. Batteries 14 are provided to generate electricity to make the light 15 flicker. An elastic article 16 is provided near the electricity-conducting portion 131 of the electric circuit plate 13. A clamping member 17 is screwed to the bottom surface of the light base 11 by a screw 18. Then, the cover 19 and the light base 11 are firmly combined together by means of ultrasonic welding.

The above-mentioned conventional structure of flickering decoration light can be hooked on the belt or a pocket of a user by means of the clamping member 17. When the switching button 12 in the bottom of the light base 11 being pressed down, the elastic article 16 will be pressed to touch the electricity-conducting portion 131 of the electric circuit plate 13 and make the light 15 flicker. The switching button 12 can be pressed down again to stop the light 15 from flickering.

However, there are following drawbacks in the conventional structure of flickering decoration light 1. The parts of the structure of flickering decoration light are numerous, and the assembling process is complicated. It is not only costs much but also wastes time and labor. Because the light base and the cover are combined together by ultrasonic welding, the batteries can not be replaced when their electricity being used up, and the whole structure has to be thrown away. Therefore, it wastes money to buy another new one.

2. It is not convenient for a user to press the switching button because the light base must be turned slantly or entirely taken away from a belt or a pocket when a user intends to press the switching button.

3. It can not be widely used and can only be hooked on a belt or a pocket of a user.

SUMMARY OF THE INVENTION

Therefore, the present invention is to provide a structure of flickering decoration light that substantially obviates the drawbacks of the related conventional art.

An object of the present invention is to provide a structure of flickering decoration light whose pressing cover can be directly pressed to switch the light.

Another object of the present invention is to provide a structure of flickering decoration light whose pressing cover can be separated from the light base by slight force so as for the batteries to be replaced when the electricity being used up.

Yet another object of the present invention is to provide a structure of flickering decoration light which is more ingenious and can simplify assembling process so as to save cost, time and labor in assembling.

It is a further object of the present invention is to provide a structure of flickering decoration light which can not only be applied on a belt, a pocket, clothes of a user but also can be widely applied on furniture or machinery for decoration or warning.

Accordingly, a structure of flickering decoration light in the present invention is assembled by a light base and a pressing cover. The flickering circuit is switched by the electricity-conducting portion of an electric circuit plate provided in the interior of the pressing cover. The upper inner wall of the light base is provided with a catching flange, and the bottom circumference of the pressing cover is provided with a stopping flange so as to be movably caught in the catching flange the light base by proper force. An elastic against post is provided with a conductor in the top and is glued to connect with the electricity-conducting portion of the electric circuit plate so as to stop against between the electric circuit plate and the light base. A fastening article is provided on the outer bottom surface of the light base. The pressing cover can be pressed to switch the electric circuit to make the decoration light flicker or be extinguished.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
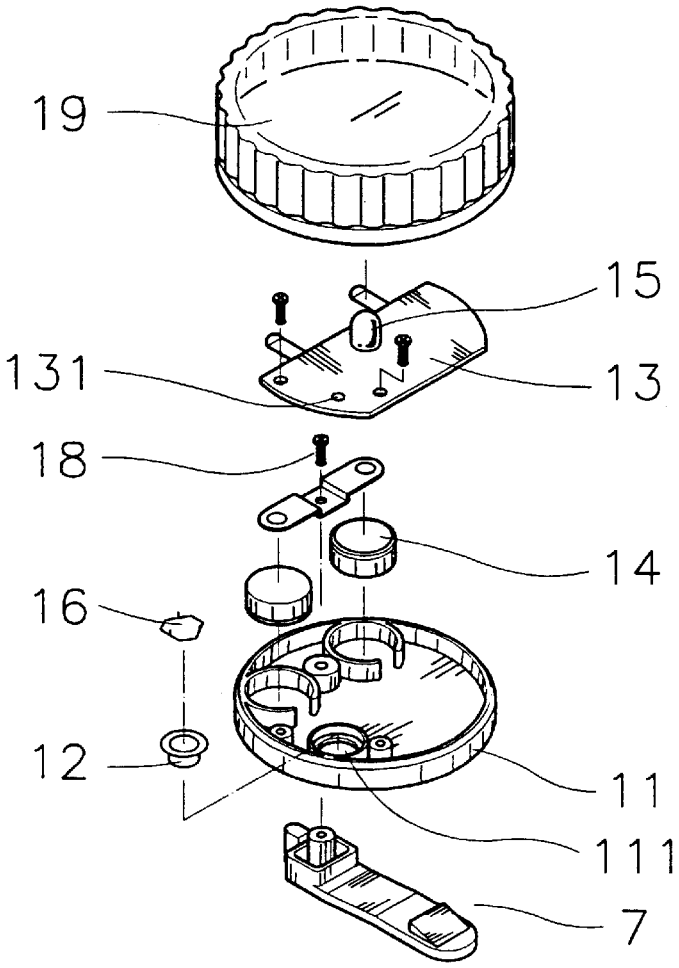
FIG. 1 (PRIOR ART)
FIG. 1 is a perspective exploded view of the conventional structure of flickering decoration light.
Figure 2:
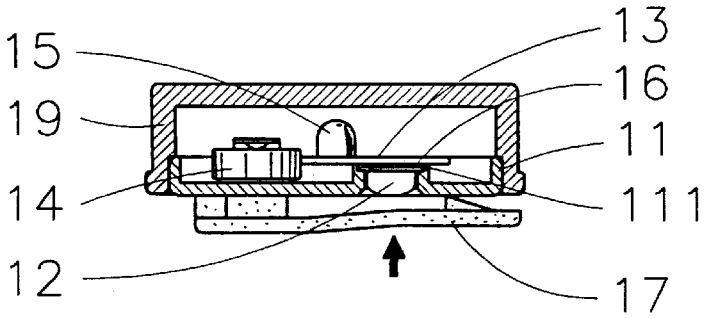
FIG. 2 (PRIOR ART)
FIG. 2 is a sectional view of the conventional structure of flickering decoration light in assembled configuration.
Figure 3:
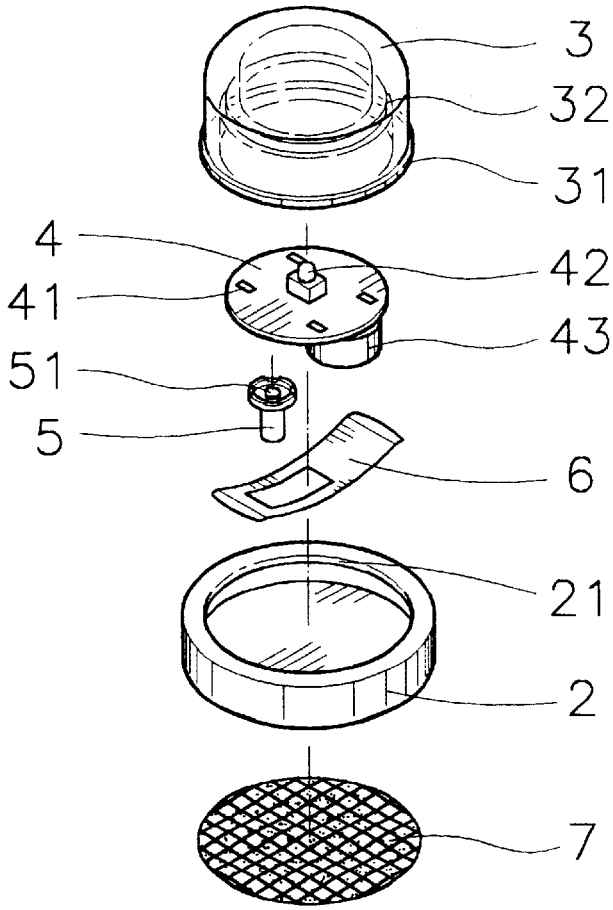
FIG. 3 is a perspective exploded view of an embodiment of the structure of flickering decoration light in accordance with the present invention.

Referring to FIG. 3, a preferred embodiment of a structure of flickering decoration light in the present invention is composed by a light base 2, a pressing cover 3, an electric circuit plate 4, an elastic against post 5 and an elastic article 6. The upper inner wall of the light base 2 is provided with a catching flange 21, and the bottom circumference of the pressing cover 3 is provided with a stopping flange 31. The electric circuit plate 4 is provided with an electricity-conducting portion 41, a light 42 and batteries 43. The elastic against post 5 is provided with a conductor 51 in the top and is glued to connect with the electricity-conducting portion 41 of the electric circuit plate 4 so as to stop against between the electric circuit plate 4 and the light base 2. The elastic article 6 is provided between the bottom of the batteries 43 and the light base 2.

Figure 4:
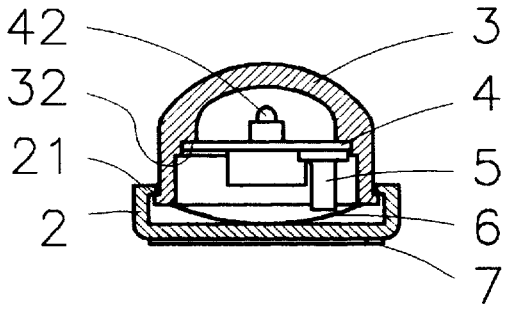
FIG. 4 is a sectional view of an embodiment of the structure of flickering decoration light in assembled configuration in accordance with the present invention.

While being assembled, referring to FIG. 4, the electric circuit plate 4 together with the elastic against post 5 and the elastic article 6 are placed and caught in the ladder interior 32 of the pressing cover 3, and the light base 2 is forced down to make the stopping flange 31 of the pressing cover 3 be caught in the light base 2. Then a fastening article 7 is provided on the outer bottom surface of the light base 2.

Figure 5:
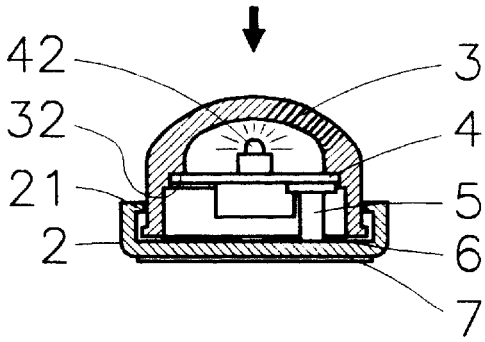
FIG. 5 is a schematic view of an embodiment of the structure of flickering decoration light showing the pressing cover being pressed down to make the light flicker in accordance with the present invention.
Figure 6:
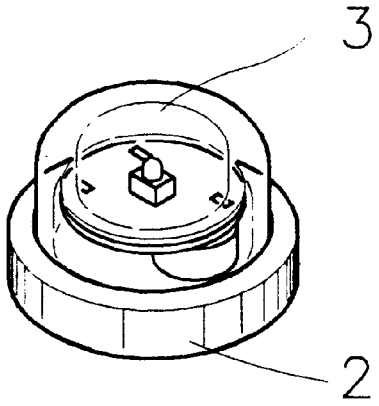
FIG. 6 is a perspective view of an embodiment of the structure of flickering decoration light in assembled configuration in accordance with the present invention; and, FIG. 7 is a schematic view showing the applied condition of the structure of flickering decoration light in accordance with the present invention.

While being operated, referring to FIGS. 4, 5 and 6, because the pressing cover 3 and the light base 2 in the present invention are movably assembled, the pressing cover 3 can be a pressing switch. When the pressing cover 3 being pressed down, the electric circuit plate 4in the ladder interior 32 of the pressing cover 3 will force the elastic against post 5 to make the conductor 51 touch the electricity-conducting portion 41 of the electric circuit plate 4 to conduct electricity. After the pressing cover 3 being loosen, the elastic against post 5 will elastically sustain the electric circuit plate 4 together with the pressing cover 3 to separate the conductor 51 in the elastic against post 5 from touching electricity-conducting portion 41, and the light 42 will keep flickering, as shown in FIG. 5. When the pressing cover 3 being pressed down again, the electric circuit will be cut off, and the light 42 will be extinguished. When the electricity of the batteries 43 being used up, the pressing cover can be separated from the light base 2 by slight force so as for the batteries 43 to be replaced by new ones.

Figure 7:
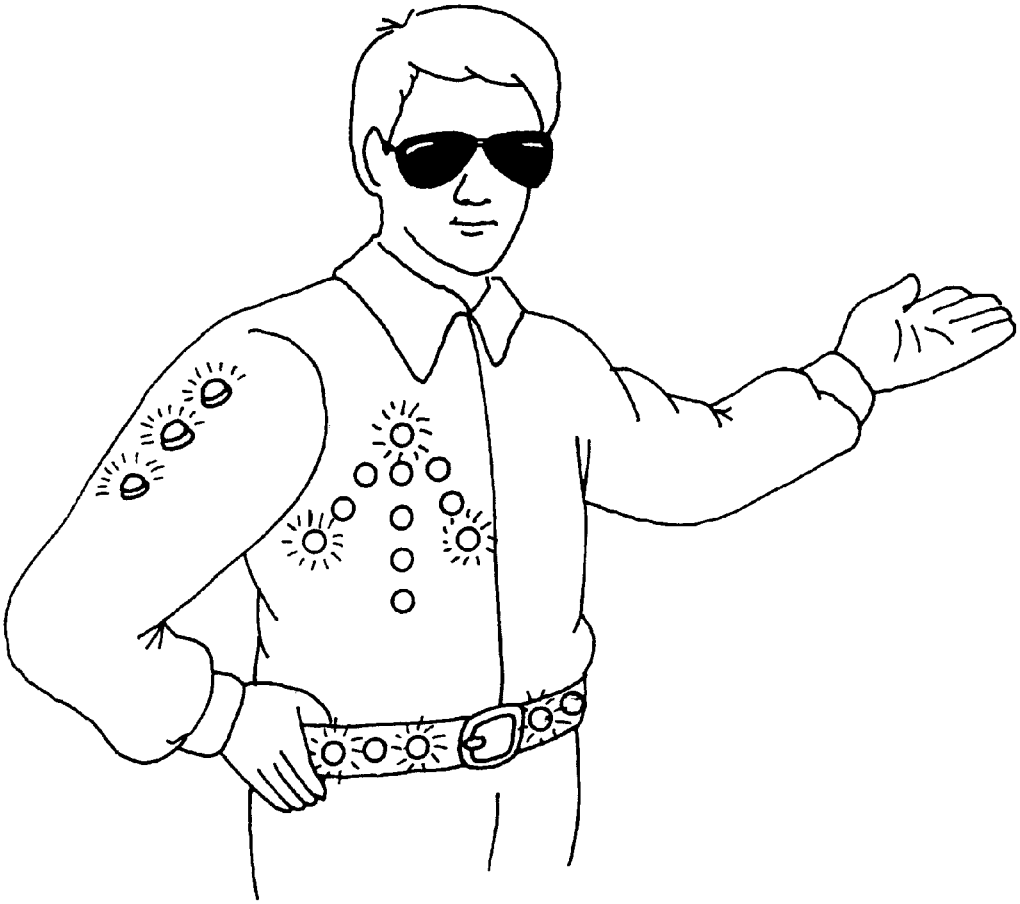

The fastening article 7 provided on the outer bottom surface of the light base 2 may be a clamping member or a piece of two-sided tape. Therefore, the flickering decoration light in the present invention can not only be applied on a belt or a pocket of a user but also be applied on the clothes of a user, as shown in FIG. 7, or on furniture and machinery for decoration or warning.

While the preferred embodiments of the invention have been described above, it will be recognized and understood that various modifications may be made therein and the appended claims are intended to cover all such modifications which may fall within the spirit and scope of the invention.

What is claimed is:

1. A structure of flickering decoration light comprising:

a light base being provided with a catching flange on upper inner wall, a fastening article being provided on the outer bottom surface of said light base;

a pressing cover being provided with a stopping flange on bottom circumference, said pressing cover able to be pressed to make said stopping flange be caught in said light base;

an electric circuit plate being placed and caught in the interior of said pressing cover, said electric circuit plate provided with an electricity-conducting portion, a light and batteries, an elastic article being provided between the bottom of said batteries and said light base; and, an elastic against post being provided with a conductor in the top and being glued to connect with said electricity-conducting portion of said electric circuit plate so as to stop against between said electric circuit plate and said light base, when said pressing cover being pressed down, said electric circuit plate in said pressing cover forcing said elastic against post to make said conductor touch said electricity-conducting portion to conduct electricity and make said decoration light flicker.

* * * * *